United States Patent [19]

Delbosse

[11] Patent Number: 4,578,734

[45] Date of Patent: Mar. 25, 1986

[54] ELECTRONIC CIRCUIT CONTROLLING A MULTIPLE OPERATION APPARATUS FITTED WITH AN ELECTROMAGNETIC MECHANISM

[75] Inventor: André Delbosse, Brussels, Belgium

[73] Assignee: Merlin Gerin, Grenoble, France

[21] Appl. No.: 551,935

[22] Filed: Nov. 15, 1983

[30] Foreign Application Priority Data

Nov. 29, 1982 [FR] France ..... 82 20111

[51] Int. Cl.[4] ..... H01H 47/32

[52] U.S. Cl. ..... 361/152; 361/186; 361/153; 361/190

[58] Field of Search ..... 361/152, 153, 165, 186, 361/190, 203, 205, 208

[56] References Cited

U.S. PATENT DOCUMENTS

| | | | |
|---|---|---|---|
| 2,926,248 | 2/1960 | DeMong | 361/186 X |
| 3,628,100 | 12/1971 | Zettler | 361/152 |
| 3,922,587 | 11/1975 | Jones | 361/186 X |
| 4,188,547 | 2/1980 | Fox | 307/239 |
| 4,293,888 | 10/1981 | McCarty | 361/152 |
| 4,323,890 | 4/1982 | Lemke | 246/5 X |

FOREIGN PATENT DOCUMENTS

| | | |
|---|---|---|
| 0050301 | 4/1982 | European Pat. Off. . |
| 2007618 | 8/1971 | Fed. Rep. of Germany . |
| 2601799 | 7/1977 | Fed. Rep. of Germany . |
| 2731610 | 1/1979 | Fed. Rep. of Germany . |
| 2816592 | 10/1979 | Fed. Rep. of Germany . |

*Primary Examiner*—Harry E. Moose, Jr.
*Assistant Examiner*—T. DeBoer
*Attorney, Agent, or Firm*—Parkhurst & Oliff

[57] ABSTRACT

The invention relates to an electronic device controlling the electromagnet of a multiple operation electrical apparatus.

The electromagnetic coil (14) is connected in series to a triac (25) regulated by a generator (32) associated with a monostable flip-flop (34) designed to supply a single pulse of time-length T at each order from a logic circuit (36). A selector (38) cooperates with each output $S_1$, $S_2$, $S_3$ . . . of the logic circuit (36) to choose a predetermined mode of operation of the apparatus (10), particularly remote-operated switch, contactor, or ON-OFF mode.

6 Claims, 5 Drawing Figures

ELECTRONIC CIRCUIT CONTROLLING A MULTIPLE OPERATION APPARATUS FITTED WITH AN ELECTROMAGNETIC MECHANISM

The invention relates to a control device for an electrical apparatus fitted with an electromagnetic driving mechanism which induces a condition change in the movable contact at each pulse energizing the electromagnetic coil, said device comprising a supply circuit to the electromagnet and a control unit inserted in said supply circuit to ensure or interrupt energizing of the coil.

A known device of the kind mentioned comprises a bistable electromechanical remote-control switch the change of condition of which causes the mechanical contacts to open or close each time the electromagnetic coil which actuates the mechanism is energized. The coil is generally supplied for a short period, for example the time during which a push-button constituting the control unit is depressed. The space taken up by the electromagnet inside the remote-control switch modular case is great in relation to the other elements of the mechanism. When the coil is energized by means of an A.C. voltage source, closing and opening of the remote-control switch contact take place at a certain moment of the sine curve. For this reason, any possibility of synchronous engagement remains impossible.

The object of this invention is to overcome these drawbacks and to enable a reliable multiple-operation modular apparatus to be produced with an electromagnet of reduced dimensions adapted to synchronous engagement.

The main feature of the control device according to the invention is that said control unit comprises a controlled static switch the conduction of which is regulated by an electronic control circuit capable of delivering control pulses for a predetermined length of time T, triggering of the switch being inhibited outside the time interval T, so as to limit the passage of current through the electromagnetic coil.

The controlled static switch is advantageously constituted by a triac electrically connected in series to the electromagnetic coil supplied from an A.C. voltage source. The electronic circuit comprises a monostable flip-flop the output of which cooperates with a synchronous pulse generating circuit to trigger the static switch when the voltage U drops close to zero, and the input of which is connected to a logic control circuit, said flip-flop supplying the generating circuit with a single pulse of length of time T on each order emanating from the logic circuit.

The use of the triac associated with its control circuit enables a reliability of operation to be obtained linked to the calibration of the control pulse triggering the triac, and to the availability of a high driving power by supercharging the electromagnetic coil for a very short length of time. The volume of the electromagnet is reduced and moreover permits synchronous engagement which consists of supplying the coil at the beginning of a voltage U alternation.

The logic circuit comprises several outputs which deliver distinct output signals $S_1$, $S_2$, $S_3$ . . . according to the condition of the input signals $E_1$, $E_2$, $E_3$ . . . determined by the control means K. The latter comprise one or several auxiliary contacts actuated manually or automatically by an automatic relay or a programmer, and a detector of the position of the movable contact of the apparatus.

A selector is advantageously associated with the control circuit to take into account a predetermined output signal $S_1$, $S_2$, $S_3$ from the logic circuit corresponding to a particular operating mode of the apparatus, i.e. remote operated switch, contactor or ON-OFF. The operating mode is indicated to the user by means of a signalling device cooperating with the selector.

Other advantages and features will become more clearly apparent in the following description of the different implementation modes of the invention, given as non-limiting examples and shown in the appended drawing figures, in which:

FIG. 1 shows the outline diagram of an electrical apparatus with an electromagnet controlled by short duration pulses by means of the electronic circuit according to the invention;

FIG. 2*a* shows how a modular apparatus and the associated electronic circuit can be housed side-by-side in two cases;

FIG. 2*b* is a variant of FIG. 2*a*, with a single case housing both the apparatus and the electronic circuit;

Figure 1:
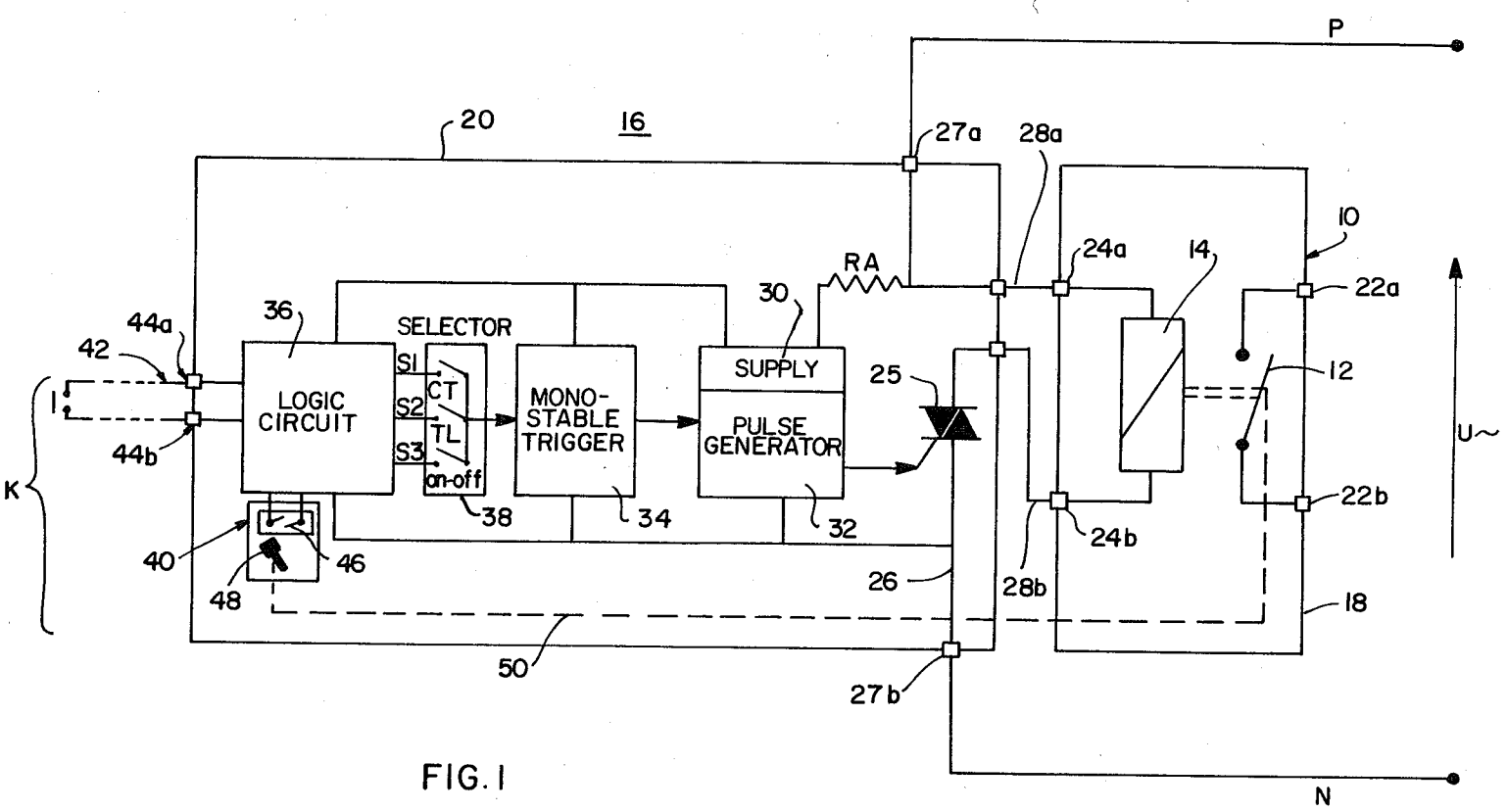
Figure 2B:
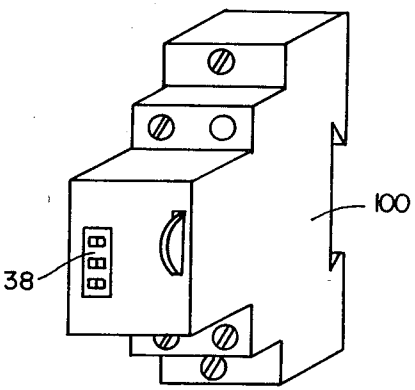
Figure 2A:
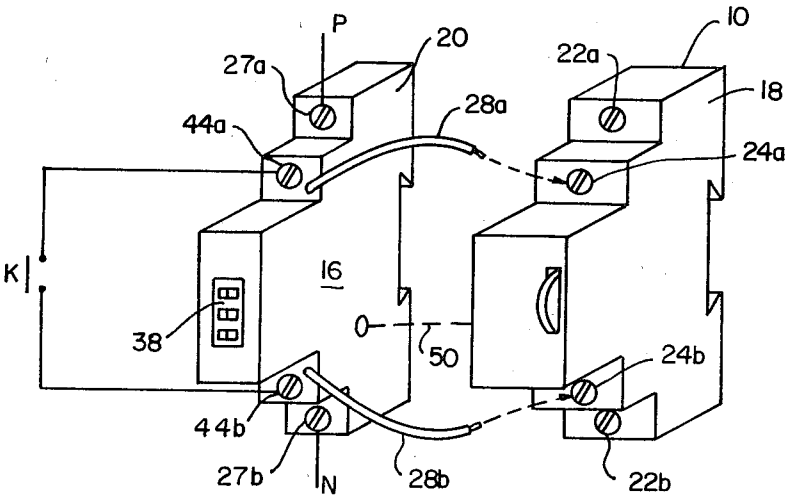

In FIGS. 1 and 2*a*, a pole of modular electrical apparatus 10 is shown, the movable contact 12 actuating mechanism of which is comprised of an electromagnet 14 regulated by an electronic control circuit 16. Electrical apparatus 10 is constituted as an example by a remote-control switch the mechanism of which induces a change in the condition of movable contact 12 with each energizing pulse from electromagnetic coil 14. This remote-control switch could be replaced by any other low voltage bistable apparatus, particularly a remote-controlled opening and closing circuit-breaker.

Apparatus 10 is housed in moulded case 18 placed side-by-side with electronic circuit 16 module 20. Apparatus 10 comprises a first pair of load circuit connecting terminals 22*a*, 22*b* linked with movable contact 12, and a second pair of terminals 24*a*, 24*b* connecting electromagnet 14 to control module 20 electronic circuit. Movable contact 12 actuating mechanism electromagnet 14 is fitted inside case 18, but it is clear that it could be fitted in a case located between case 18 and module 20 when apparatus 10 is a remote-controlled circuit-breaker.

Electromagnet 14 is connected in series to a controlled static switch, particularly a triac 25, designed to open and close electromagnet 14 supply circuit 26, connected to an A.C. voltage U source by power conductors P and N linked with terminals 27*a*, 27*b* of module 20. Triac 25 is incorporated in module 20 which is connected electrically to electromagnet 14 by linking conductors 28*a*, 28*b* connected to terminals 24*a*, 24*b* respectively of apparatus 10. Apparatus 10 supply circuit 26 comprises in series conductor N, terminal 27*b* of module 10, triac 25, linking conductor 28*b*, terminal 24*b*, electromagnetic coil 14, terminal 24*a*, linking conductor 28*a*, terminal 27*a* and conductor P. Voltage source U is supplied as an example by the 220 Volt A.C. mains supply. A resistor $R_A$ is fitted between terminal 27*a* and power supply 30 constituted by a voltage regulating circuit which supplies electronic circuit 16 with D.C. voltage from the mains supply A.C. voltage U. Triac 25 control electrode is linked with a generating circuit 32 delivering synchronous pulses at each half-period of voltage U and when the voltage drops close to zero, to trigger triac 25. Generating circuit 32 is connected to monostable flip-flop 34 the output of which provides a single pulse on each input order coming from the logic control circuit 36. The width T of the output pulse of flip-flop 34 determines the length of time during which generating circuit 32 will supply triggering pulses to triac 25, that is to say the time the current will pass through electromagnet 14 of apparatus 10. Monostable flip-flop 34 comprises a Schmitt trigger or any other operator or shaping circuit wherein the change in condition from 0 to 1 at input leads to condition 1 at output, the output remaining in this condition for the length of time T defined by the characteristics of the operator, independently from the time the input remains in condition 1.

A selector 38 with three setting contact studs is fitted electrically between logic control circuit 36 and monostable flip-flop 34 to choose the logic circuit 36 output corresponding to a predetermined mode of operation of apparatus 10. The first position CT (output $S_1$) imposes operation as contactor, the second position TL (output $S_2$) corresponds to remote-operated switch mode, and the third ON-OFF (output $S_3$) to opening-closing operation depending on the position of contacts 12 of the apparatus. Switching of selector 38 is carried out on the front face of module 20, and the three distinct operating modes depend on the shape of the control signal from logic circuit 36 operating in conjunction with position detector 40 of contacts 12 of remote-operated switch 10 and control means K comprising one or several auxiliary contacts actuated by push-buttons, a programmer or an automatic relay. The auxiliary contacts of logic circuit control means K are connected electrically to terminals 44*a*, 44*b* of module 20 by linking circuit 42.

Detector 40 of position of contacts 12 of apparatus 10 comprises as an example a Reed relay the control contact 46 of which is actuated by a movable permanent magnet 48 fixed to a unit 50 transmitting movement of main movable contacts 12 of apparatus 10. Control contact 46 of detector 40 is either open when movable contact 12 of apparatus 10 is itself open, or closed when contact 12 is in closed position.

FIG. 2*b* shows a single-unit apparatus 100 housing both electronic circuit 16 and electromagnet 14 remote-control switch. Selector 38 is fitted with a signalling device (not shown), for example with electro-luminous diodes, which indicates on the front of apparatus 10 (FIG. 2*a*) or 100 (FIG. 2*b*) its operating mode according to the position of selector 38.

Figure 3:
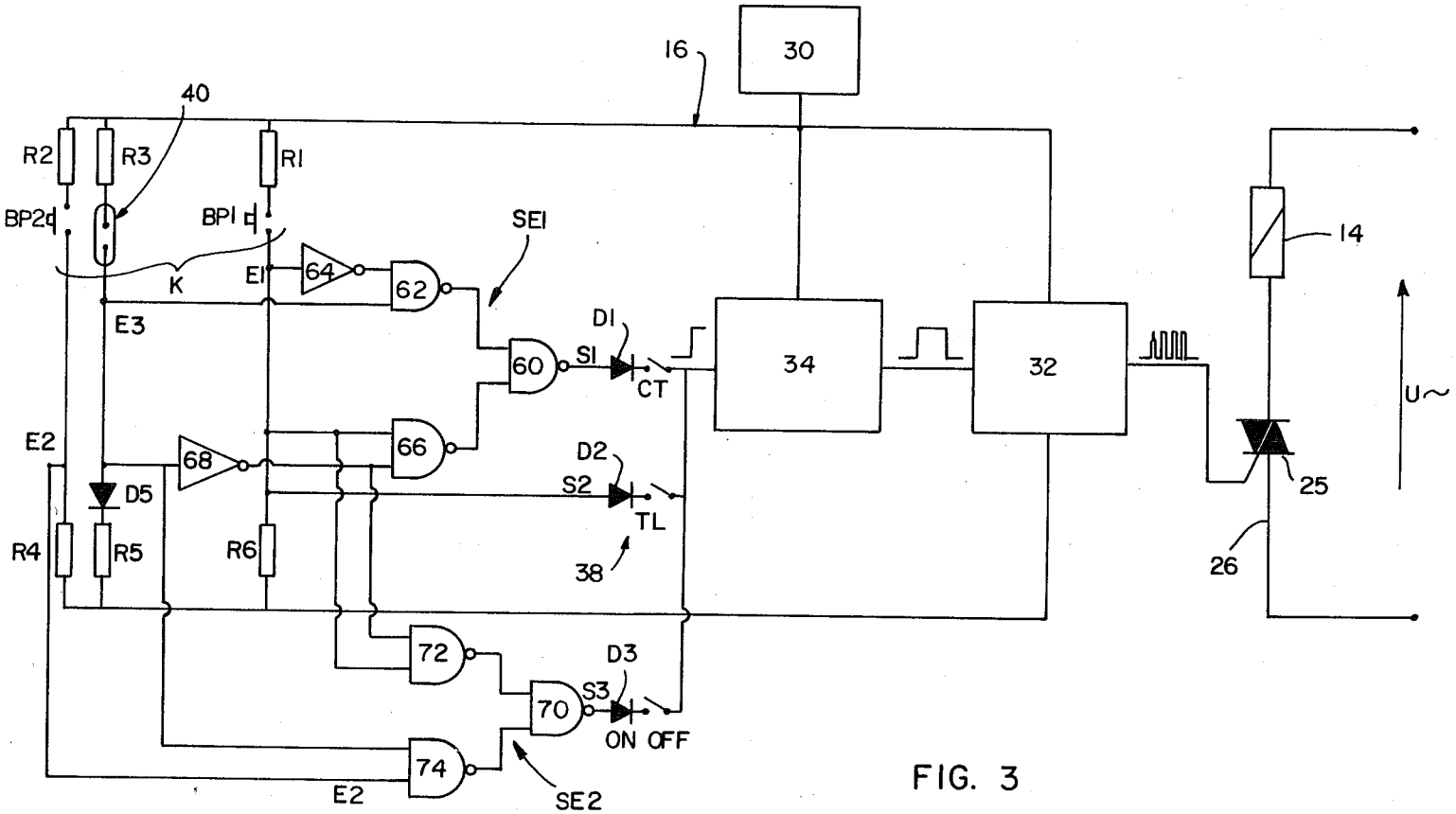
FIG. 3 illustrates the control module logic circuit according to FIG. 1.

FIG. 3 shows the lay-out of monostable flip-flop 34 logic control circuit 36. The control means K (FIGS. 1 and 2*a*) comprise a first push-button $BP_1$ used to generate a common control signal $E_1$ corresponding to contactor, remote-operated switch and closing ON functions. A second push-button $BP_2$ delivers a control signal $E_2$ which ensures the opening OFF function. The two control signals $E_1$, $E_2$ both present two logic conditions 0 or 1 corresponding respectively to opening and closing of push-buttons $BP_1$, $BP_2$. A third control signal $E_3$ emanates from position detector 40 so that opening or closing of main movable contact 12 of associated apparatus 10 is expressed by a logic condition 0 or 1 respectively at detector 40 output. Positive logic is thus used to explain the operation of circuit 36.

Logic circuit 36 comprises a first sub-unit $SE_1$ fitted with a NAND gate 60 which supplies an output signal $S_1$ applied by means of a diode $D_1$ to the first contact stud CT of selector 38. A NAND gate 62 output is connected to one of the gate 60 inputs, one of gate 62 inputs being connected to detector 40 output and the other input being connected to the push-button $BP_1$ output by a NOT gate 64. The other gate 60 input is connected to another NAND gate 66 linked on the one hand to push-button $BP_1$ and on the other hand to detector 40 by means of a NOT gate 68. It is noted that NAND gate 62 is sensitive to input signals $\overline{E_1}$ and $E_3$, whereas the two gate 66 inputs receive control signals $E_1$ and $\overline{E_3}$. This first sub-unit $SE_1$ generates the contactor function, and NAND gate 60 output $S_1$ voltage is defined by the following relationship:

$$S_1=\overline{\overline{\overline{E_1}\cdot E_3}\cdot\overline{E_1\cdot\overline{E_3}}}=\overline{E_1}\cdot E_3+E_1\cdot\overline{E_3} \qquad (1)$$

The truth table below shows the logic condition of the signal at different points of sub-unit $SE_1$ (contactor logic):

| $BP_1$ $E_1$ | Detector 40 $E_3$ | Gate 60 output $S_1$ | Apparatus 10 |
|---|---|---|---|
| 0 | 0 | 0 | open |
| 1 | 0 | 1 | order to change condition |
| 1 | 1 | 0 | closed |
| 0 | 1 | 1 | order to change condition |

In this table, logic condition 0 represents an absence of data or lack of voltage, whereas logic condition 1 corresponds to a presence of voltage data (positive logic). It is noted that output $S_1$ voltage is equal to 1 for the combination $\overline{E_1}\cdot E_3$ or $E_1\cdot\overline{E_3}$, and to O for the combination $E_1\cdot E_3$ or $\overline{E_1}\cdot\overline{E_3}$. For sub-unit $SE_1$ signal to go to logic condition 1 corresponding to an order to change position of contact 12 of apparatus 10, input $E_1$ and $E_3$ signals must present a logic condition different from each other. Output $S_1$ signal remains in condition O when $SE_1$ inputs receive simultaneously control signals $E_1$ and $E_3$ having the same logic condition.

The second contact stud TL of selector 38 is connected by means of a diode $D_2$ directly to the first push-button $BP_1$. The output $S_2$ voltage applied to contact stud TL sets off the remote operated switch function generated only by actuation of push-button $BP_1$. A logic condition 1 of $S_2$ corresponds to each closing of $BP_2$ inducing a change in condition of contact 12 of apparatus 10 independently of the positions of detector 40 and of the second push-button $BP_2$.

The third contact stud ON-OFF of selector 38 is connected by a diode $D_3$ to a NAND gate 70 of a second sub-unit $SE_2$ of circuit 36. One of the gate 70 inputs is connected to the output of a NAND gate 72 connected in parallel to the input terminals of gate 66, gate 72 being sensitive to control signals $E_1$ and $\overline{E_3}$. The other gate 70 input is regulated by another NAND gate 74 connected to detector 40 and to the second push-button $BP_2$ to receive control signals $E_2$ and $E_3$. This second sub-unit $SE_2$ with three input variables obtains the opening-closing function, and gate 70 output $S_3$ voltage is determined by the following logic relationship:

$$S_3=\overline{\overline{\overline{E_2}\cdot E_3}\cdot\overline{E_1\cdot\overline{E_3}}}=E_2\cdot E_3+E_1\cdot\overline{E_3} \qquad (2)$$

in which the control voltages $E_1$, $E_2$ and $E_3$ applied to the $SE_2$ outputs correspond respectively to the condition of the first push-button $BP_1$, the second push-button $BP_2$ and the Reed relay position detector. The positive logic truth table shows the logic conditions of the signals at different points of sub-unit $SE_2$:

| $BP_1$ $E_1$ | $BP_2$ $E_2$ | Detector 40 $E_3$ | Gate 70 output $S_3$ | Apparatus 10 |
|---|---|---|---|---|
| 0 | 0 | 0 | 0 | open |
| 1 | 0 | 0 | 1 | order to change condition |
| 1 | 0 | 1 | 0 | closed |
| 0 | 0 | 1 | 0 | closed |
| 0 | 1 | 1 | 1 | order to change condition |
| 0 | 1 | 0 | 0 | open |
| 1 | 1 | 0 | 1 | order to change condition → closing |
| 1 | 1 | 1 | 1 | order to change condition → opening |

The switch of output $S_3$ voltage to logic condition 1 occurs for the combination $E_2 \cdot E_3$ or $E_1 \cdot \overline{E_3}$, that is to say when the control voltages $E_2$ and $E_3$ are in condition 1 corresponding to the simultaneous closing of push-button $BP_2$ and of contact 12 of apparatus 10, or when the control voltage $E_1$ is in condition 1 (closing of $BP_1$) while the control voltage $E_3$ is at the same time in condition O (opening of contact 12).

It is noted that the two sub-units $SE_1$ and $SE_2$ of logic circuit 36 are made up of NAND and NOT gates, but it is obvious that circuit 36 could be designed using other combinatory operators enabling logic functions (1) and (2) corresponding to ouput $S_1$ and $S_3$ voltages to be obtained.

Push-button $BP_1$, push-button $BP_2$ and detector 40 are connected to one of the poles of power supply 30 by resistors $R_1$, $R_2$, $R_3$ respectively, and to the other pole by resistors $R_6$, $R_4$ and $R_5$ in series with a diode $D_5$.

Figure 4:
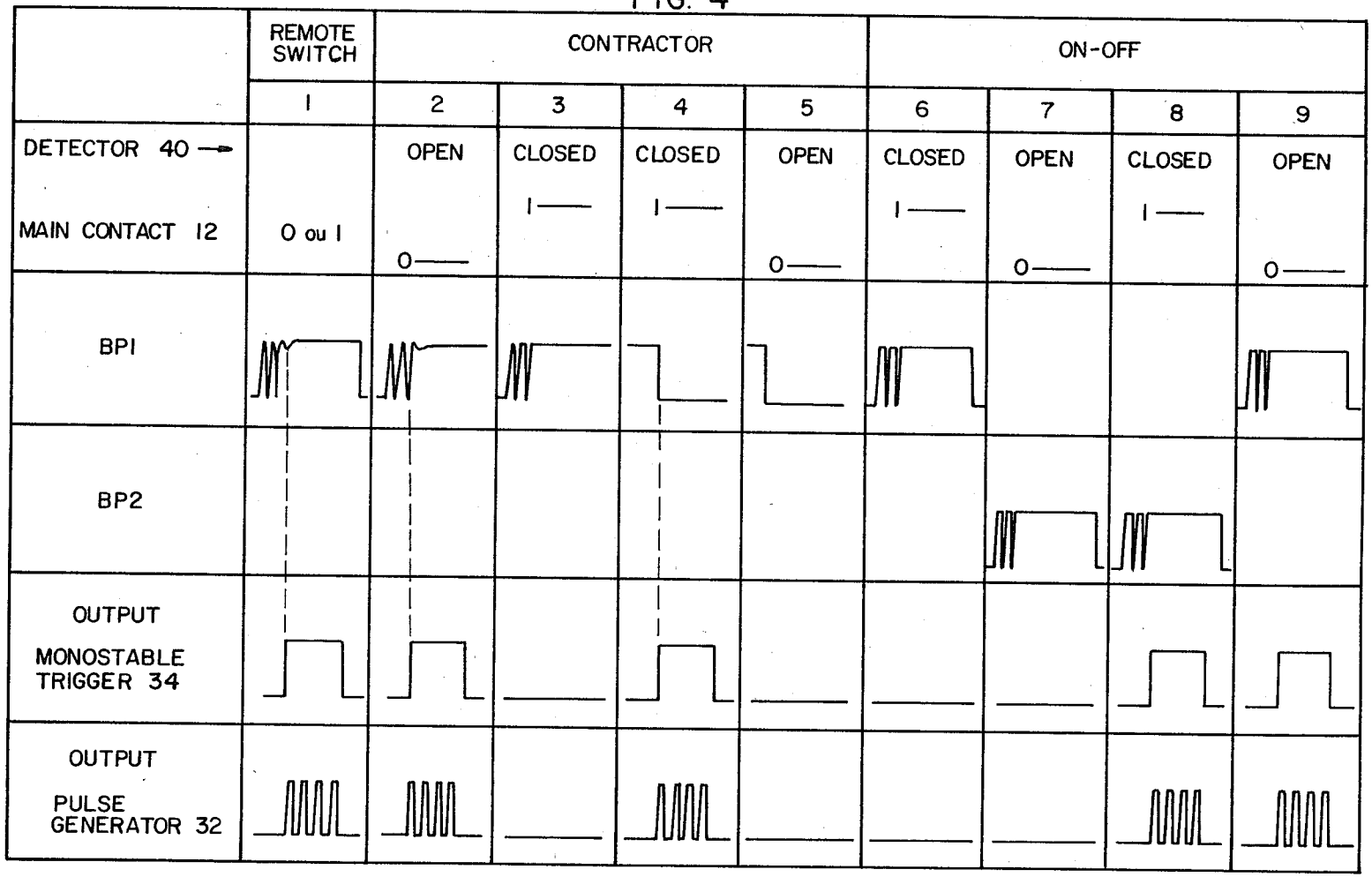
FIG. 4 shows the shape of the control signals at different points in the circuit of FIG. 3 for the three selector positions.

Operation of apparatus 10 associated with electronic circuit 16 is as follows, FIG. 4 illustrating the shape of the signals at different points of circuit 16 according to the position of selector 38:

(1) REMOTE OPERATED SWITCH MODE

Selector 38 is in position TL whereas the two other positions CT and ON-OFF are out of service. Apparatus 10 acts as a remote-operated switch. Output $S_2$ of logic circuit 36 is connected to monostable flip-flop 34 input. A control order to output $S_2$ (logic condition 1) corresponds to each closing of the first push-button. Flip-flop 34 supplies a single constant pulse of time-length T to generating circuit 32 at each order from output $S_2$, the pulses delivered by the generating circuit 32 to trigger triac 25 occur synchronously at each half-period and when the voltage drops close to zero for a time-length T of the control pulse from monostable flip-flop 34. This results in synchronous engagement. The length of time the current passes through coil 14 of the remote-operated switch is very limited, even if push-button $BP_1$ remains depressed in closed position. Calibration of the control pulse by flip-flop 34 enables a high driving power to be obtained by supercharging coil 14 of remote-operated switch for a very short length of time fixed by T. It is noted that measurement of the position of movable contact 12 does not intervene in this mode of operation.

(2) CONTACTOR MODE

Selector 38 is switched to position CT, the two other positions being out of service. The control order at the output of gate 60 of the first sub-unit $SE_1$ depends on the condition of the main movable contact 12 (detector 40) and of the first push-button $BP_1$, as formulated previously in relationship (1). The switch of output $S_1$ voltage to logic condition 1 corresponding to an order to change the position of contact 12 requires push-button $BP_1$ and detector 40 to be at different logic levels from each other, i.e. that contact 12 be open when $BP_1$ is closed, or that contact 12 be closed when push-button $BP_1$ is released, the latter returning automatically to the open position. In the first case, maintaining push-button $BP_1$ in closed position ensures closing of contact 12 of apparatus 10 (see column 2, FIG. 4). In the second case, releasing push-button $BP_1$ causes contact 12 to return to the open position (see column 4, FIG. 4). Apparatus 10 acts in this way as a contactor. It is noted that depressing push-button $BP_1$ with contact 12 in closed position does not induce any change in condition of apparatus 10 (column 3). Similarly when push-button $BP_1$ is released and contact 12 is open (see column 5). In the latter two cases, contact 12 remains in its initial position.

The order to change condition (columns 2 and 4) emitted by output $S_1$ of circuit 36 to monostable flip-flop 34 causes triggering of triac 25 and power to be supplied to coil 14, the latter remaining energized for the time-length T fixed by flip-flop 34.

(3) ON-OFF MODE

Selector 38 is switched to position ON-OFF, the two other positions being out of service. The control order at the output of gate 70 of the second sub-unit $SE_2$ depends on the condition of main movable contact 12 (detector 40), of the first push-button $BP_1$ and of the second push-button $BP_2$, as formulated previously in relationship (2). The switch of output voltage $S_3$ to logic condition 1 occurs when main contact 12 is closed and push-button $BP_2$ is actuated (column 8, FIG. 4), or when contact 12 is open and push-button $BP_1$ is closed (column 9, FIG. 4). This results in coil 14 being energized for a time-length T determined by flip-flop 34, so as to induce opening of contact 12 in the first case, and its closing in the second case. The other sequences are shown in the truth table.

It is noted that a predetermined operating mode of apparatus 10 corresponds to each position CT, TL and ON-OFF of selector 38, i.e. contactor, remote-operated switch and opening-closing. This mode is indicated by the LED diode signalling device. It is also possible to combine two contact studs of selector 38 to obtain a particular sequence, for instance by switching the selector to both TL and ON-OFF positions. On actuating the first push-button $BP_1$, the apparatus acts as remote-operated switch. Closing the second push-button or auxiliary contact $BP_2$ causes actual opening of contact 12 of apparatus 10.

A delayed action safety device (not shown) is fitted to monostable flip-flop 34 output to prevent several successive attempts to trigger triac 25 due to repeated manipulation of push-buttons $BP_1$ and $BP_2$. A protective device, particularly a fuse or thermistor (not shown) is fitted in series to the electromagnetic coil 14, the latter being thus protected should triac 25 be destroyed.

The invention is of course not limited to the embodiment more particularly described herein and represented in the appended drawings, but on the contrary covers any variant that comes within the framework of electrotechnical equivalents.

I claim:

1. Control device of an electrical apparatus having a movable contact and an electromagnetic driving mechanism with an electromagnetic coil inducing a change in condition of the movable contact at each time the electromagnetic coil is energized, said control device comprising a power supply circuit to said electromagnetic coil and a control unit inserted in said supply circuit to energize or de-energize the coil, said control unit including a controlable static switch and an electronic control circuit capable of delivering control pulses for the triggering of said static switch for a predetermined time-length T, so as to limit the current supply passing through said electromagnetic coil, said electronic control circuit including:

a synchronous pulse generating circuit to trigger said static switch when the voltage of said power supply circuit drops close to zero;

a monostable trigger circuit for supplying the pulse generating circuit with a single pulse of time-length T, and;

a logic control unit having an output connected to the input of said trigger circuit;

said logic control unit comprising a plurality of outputs delivering distinct output signals according to the condition of input signals applied to the input of the logic control unit; and a selector connected between said logic control unit and said monostable trigger circuit to choose the operating mode of said apparatus, the number of positions of said selector being identical to the number of logic control unit outputs.

2. Control device as set forth in claim 1, having control means including auxiliary contacts and a position detector of said movable contact, which are connected to the input of said logic control unit.

3. Control device as set forth in claim 2, wherein said control means comprises a first push-button auxiliary contact delivering first input signal $E_1$ common to all operating modes of said apparatus, a second push-button auxiliary contact delivering a second input signal $E_2$ for opening OFF control of said apparatus, said position detector delivering a third input signal $E_3$.

4. Control device as set forth in claim 3, wherein said logic control unit comprises a first sub-unit of combinative elements sensitive to the two input signals $E_1$ and $E_3$, to supply a first position of said selector with an output signal defined by the relationship $\overline{E}_1 \cdot E_3 + E_1 \cdot \overline{E}_3$ corresponding to contactor logic.

5. Control device as set forth in claim 4, wherein said logic control unit comprises a second sub-unit of combinative elements sensitive to the three signals $E_1$, $E_2$, $E_3$, to supply a third position of said selector with an output signal defined by the relationship $E_2 \cdot E_3 + E_1 \cdot E_3$ corresponding to opening-closing logic.

6. Control device as set forth in claim 5, wherein a second position of said selector cooperates directly with said first push-button auxiliary contact so that each actuation brings about the emission of an output signal corresponding to remote-operated switch function.

* * * * *